US007193602B2

(12) United States Patent
Morita

(10) Patent No.: US 7,193,602 B2
(45) Date of Patent: Mar. 20, 2007

(54) DRIVER CIRCUIT, ELECTRO-OPTICAL DEVICE, AND DRIVING METHOD

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 431 days.

(21) Appl. No.: 10/714,872

(22) Filed: Nov. 18, 2003

(65) Prior Publication Data

US 2004/0145581 A1 Jul. 29, 2004

(30) Foreign Application Priority Data

Nov. 21, 2002 (JP) ..... 2002-337907

(51) Int. Cl.
*G09G 3/36* (2006.01)

(52) U.S. Cl. ..... 345/100; 345/55; 345/87; 345/98

(58) Field of Classification Search ..... 345/100, 345/55, 87, 98
See application file for complete search history.

(56) References Cited

U.S. PATENT DOCUMENTS 6,566,643 B2 5/2003 Morita
6,700,562 B1 * 3/2004 Knapp et al. ..... 345/98
6,806,854 B2 * 10/2004 Cairns et al. ..... 345/87
7,034,276 B2 4/2006 Morita
7,154,488 B2 12/2006 Morita

* cited by examiner

*Primary Examiner*—Richard Hjerpe
*Assistant Examiner*—Leonid Shapiro
(74) *Attorney, Agent, or Firm*—Oliff & Berridge, PLC

(57) ABSTRACT

A display panel includes first to third scan lines, first to third color component signal lines, first to third switching elements which are connected to the first to third scan lines and the first to third color component signal lines respectively and controlled by first to third select signals, first to third pixel electrodes, and first to third demultiplex switching elements which output multiplexed color component signals to the color component signal lines. A select signal generation circuit generates a jth select signal ($1 \leqq j \leqq 3$, j is an integer) so that at least a jth switching element is in an ON state when a jth demultiplex switching element shifts from an ON state to an OFF state and the jth switching element is set to an OFF state before the jth demultiplex switching element is set to the ON state again after the jth demultiplex switching element has shifted to the OFF state.

10 Claims, 10 Drawing Sheets

DRIVER CIRCUIT, ELECTRO-OPTICAL DEVICE, AND DRIVING METHOD

Japanese Patent Application No. 2002-337907 filed on Nov. 21, 2002, is hereby incorporated by reference in its entirety.

BACKGROUND OF THE INVENTION

The present invention relates to a driver circuit, an electro-optical device, and a driving method.

A display panel (electro-optical device in a broad sense) represented by a liquid crystal display (LCD) panel is used as a display section of various information instruments. There has been a demand for reduction of the size and weight of the information instrument and an increase in the image quality. Therefore, reduction of the size of the display panel and reduction of the pixel size have been demanded. As one solution to satisfy such a demand, a method of forming a display panel by using a low temperature polysilicon (hereinafter abbreviated as "LTPS") process has been studied.

BRIEF SUMMARY OF THE INVENTION

According to one aspect of the present invention, there is provided a driver circuit for driving an electro-optical device which has:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element; and first to ith demultiplex switching elements, each of which is connected to the jth color component signal line at one end and to a signal line at the other end, and is controlled by a jth demultiplex control signal, multiplexed first to ith color component signals being output to the signal line, the driver circuit comprising a select signal generation circuit which generates first to ith select signals, the first to ith select signals controlling the first to ith switching elements based on first to ith demultiplex control signals respectively, wherein the select signal generation circuit generates the jth select signal so that at least the jth switching element is in an ON state when a jth demultiplex switching element shifts from an ON state to an OFF state and that the jth switching element is set to an OFF state before the jth demultiplex switching element is set to the ON state again after the jth demultiplex switching element has shifted to the OFF state.

According to another aspect of the present invention, there is provided an electro-optical device comprising:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element; and first to ith demultiplex switching elements, each of which is connected to the jth color component signal line at one end and to a signal line at the other end, and is controlled by a jth demultiplex control signal, multiplexed first to ith color component signals being output to the signal line, wherein the jth switching element is set to an ON state based on the jth select signal when a jth demultiplex switching element shifts from an ON state to an OFF state, and set to an OFF state based on the jth select signal before the jth demultiplex switching element is set to the ON state again after the jth demultiplex switching element has shifted to the OFF state.

According to a further aspect of the present invention, there is provided an electro-optical device comprising:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element;

first to ith demultiplex switching elements, each of which is connected to the jth color component signal line at one end and to a signal line at the other end, and is controlled by a jth demultiplex control signal, multiplexed first to ith color component signals being output to the signal line; and a select signal generation circuit which generates first to ith select signals, the first to ith select signals controlling the first to ith switching elements based on first to ith demultiplex control signals respectively, wherein the select signal generation circuit generates the jth select signal so that at least the jth switching element is in an ON state when a jth demultiplex switching element shifts from an ON state to an OFF state and that the jth switching element is set to an OFF state before the jth demultiplex switching element is set to the ON state again after the jth demultiplex switching element has shifted to the OFF state.

According to still another aspect of the present invention, there is provided a method of driving an electro-optical device which has:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element; and first to ith demultiplex switching elements, each of which is connected to the jth color component signal line at one end and to a signal line at the other end, and is controlled by a jth demultiplex control signal, multiplexed first to ith color component signals being output to the signal line, the method comprising setting at least the jth switching element to an ON state based on the jth select signal when a jth demultiplex switching element shifts from an ON state to an OFF state, and setting the jth switching element to an OFF state based on the jth select signal before the jth demultiplex switching element is set to the ON state again after the jth demultiplex switching element has shifted to the OFF state.

DETAILED DESCRIPTION OF THE EMBODIMENT

Figure 1:
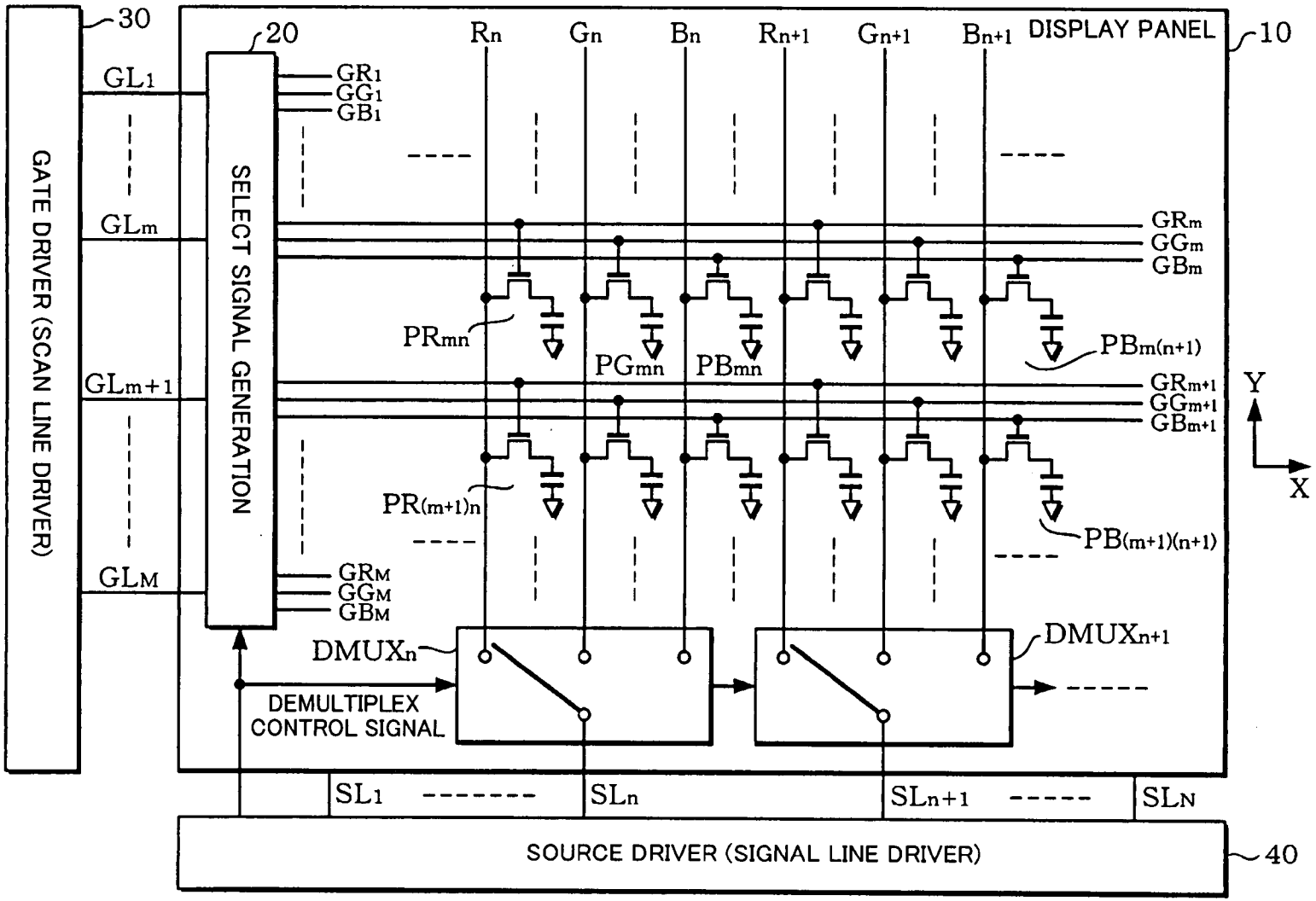
FIG. 1 is a block diagram showing an outline of a configuration of a display panel in an embodiment of the present invention.

Embodiments of the present invention are described below. Note that the embodiments described hereunder do not in any way limit the scope of the invention defined by the claims laid out herein. Note also that all of the elements described below should not be taken as essential requirements for the solution means of the present invention.

According to the LTPS process, a driver circuit and the like can be directly formed on a panel substrate (glass substrate, for example) on which pixels including a switching element (thin film transistor (TFT), for example) and the like are formed. This enables the number of parts to be decreased, whereby the size and weight of the display panel can be reduced. Moreover, LTPS enables the pixel size to be reduced by applying a conventional silicon process technology while maintaining the aperture ratio. Furthermore, LTPS has high charge mobility and small parasitic capacitance in comparison with amorphous silicon (a-Si). Therefore, a charging period of the pixel formed on the substrate can be secured even if the pixel select period per pixel is reduced due to an increase in the screen size, whereby the image quality can be improved.

In a display panel in which the TFT is formed by LTPS, the entire drivers (driver circuits) which drive the display panel can be formed on the panel. However, this results in a problem relating to reduction of the size or an increase in the speed in comparison with the case where an IC is mounted on a silicon substrate. Therefore, a method of forming a part of the functions of the drivers on the display panel has been studied.

A display panel may be provided with a demultiplexer which connects one signal line with one of R, G, and B signal lines which can be connected to pixel electrodes for R, G, and B (first to third color components which make up one pixel). In this case, display data for R, G, and B is transmitted on the signal line by time division by utilizing the high charge mobility of LTPS. The display data for each color component is consecutively and selectively output to the R, G, and B signal lines by the demultiplexer in the select period of the pixel, and written in the pixel electrodes provided for each color component. According to this configuration, the number of terminals for outputting the display data to the signal line from the driver can be reduced. Therefore, it is possible to deal with an increase in the number of signal lines due to reduction of the pixel size without being restricted by the pitch between the terminals.

However, in the display panel having such a configuration, a difference in write time occurs between the pixel electrodes for each color component in the select period of the pixel depending on the order of writing of the display data for each color component. This adversely affects the image quality.

According to the following embodiments, a driver circuit for an electro-optical device capable of preventing deterioration of image quality due to the difference in write time of the display data for each color component, an electro-optical device, and a method of driving the same can be provided.

The embodiments of the present invention are described below in detail with reference to the drawings.

The following description is given taking a display panel (liquid crystal panel) in which a TFT is formed as a switching element by LTPS as an example of an electro-optical device. However, the present invention is not limited thereto.

FIG. 1 shows an outline of a configuration of a display panel in the present embodiment. A display panel (electro-optical device in a broad sense) 10 includes a plurality of scan lines (gate lines), a plurality of signal lines (data lines), and a plurality of pixels. The scan lines and the signal lines are disposed to intersect. The pixels are specified by the scan lines and the signal lines.

In the display panel 10 in the present embodiment, one pixel is formed of i dots (i is an integer of two or more) of color components. Each dot includes a TFT and a pixel electrode. In each dot of the pixel selected by the scan line, a voltage corresponding to gray-scale data for each color component is written in the pixel electrode in the select period of the pixel.

FIG. 1 illustrates the case where one pixel is formed of three dots (i=3).

In the display panel 10, the scan lines and the signal lines are formed on a panel substrate such as a glass substrate. In more detail, a plurality of scan lines $GL_1$ to $GL_M$ (M is an integer of two or more) which are arranged in the Y direction shown in FIG. 1 and extend in the X direction, and a plurality of signal lines $SL_1$ to $SL_N$ (N is an integer of two or more) which are arranged in the X direction shown in FIG. 1 and extend in the Y direction are formed on the panel substrate. A plurality of first to third (i=3) scan lines ($GR_1$, $GG_1$, $GB_1$) to ($GR_M$, $GG_M$, $GB_M$) (first to third scan lines are arranged to make a set) which extend in the X direction and a plurality of first to third color component signal lines ($R_1$, $G_1$, $B_1$) to ($R_N$, $G_N$, $B_N$) (first to third color component signal lines make a set) which are arranged in the X direction and extend in the Y direction are formed on the panel substrate. The interconnect region of the first to third (i=3) scan lines may be reduced by forming the first to third scan lines by using a three-layer interconnect, for example.

R pixels PR are formed at intersecting points of the first scan lines $GR_1$ to $GR_M$ and the first color component signal lines $R_1$ to $R_N$. G pixels PG are formed at intersecting points of the second scan lines $GG_1$ to $GG_M$ and the second color component signal lines $G_1$ to $G_N$. B pixels PB are formed at intersecting points of the third scan lines $GB_1$ to $GB_M$ and the third color component signal lines $B_1$ to $B_N$.

A select signal generation circuit 20 and demultiplexers $DMUX_1$ to $DMUX_N$ provided corresponding to each signal line are formed on the panel substrate.

The scan lines $GL_1$ to $GL_M$ and the first to third scan lines ($GR_1$, $GG_1$, $GB_1$) to ($GR_M$, $GG_M$, $GB_M$) (first to third scan lines are arranged to make a set) are connected to the select signal generation circuit 20. A demultiplex control signal is input to the select signal generation circuit 20. The demultiplex control signal is a signal for controlling switching of each of the demultiplexers.

The scan lines $GL_1$ to $GL_M$ are driven by a gate driver (scan line driver circuit) 30 provided outside the display panel 10. The gate driver 30 outputs gate signals (select pulses) to the scan lines $GL_1$ to $GL_M$ in that order. The gate driver 30 includes a shift register. The shift register may be formed by using a plurality of flip-flops $FF_1$ to $FF_M$ (not shown). The shift register may be formed by connecting the output of the flip-flop $FF_p$ ($1 \leqq p \leqq M-1$, p is an integer) with the input of the flip-flop $FF_{p+1}$ in the subsequent stage, for example. The output of the flip-flop $FF_p$ is connected to the scan line $GL_p$. The gate signal input to the flip-flop $FF_1$ in the first stage is shifted by using a given clock signal. The shift output from each flip-flop is output to the scan lines $GL_1$ to $GL_M$. This enables the gate signals which exclusively select each of the scan lines $GL_1$ to $GL_M$ to be output to the scan lines $GL_1$ to $GL_M$. The select period of each pixel or each dot in the display panel 10 is specified by the gate signal output to the scan line in this manner.

The demultiplex control signal is generated by a source driver (signal line driver circuit) 40. The select signal generation circuit 20 generates first to third (i=3) select signals in units of the scan lines based on the demultiplex control signal.

The select signal generation circuit 20 may generate the first to third select signals based on the gate signal input through each scan line and the demultiplex control signal. In this case, when the gate signal is input through the scan line $GL_m$ ($1 \leqq m \leqq M$, m is an integer), the select signal generation circuit 20 generates the first to third select signals based on the gate signal and the demultiplex control signal.

The first select signal is a signal for selecting the R (first color component) pixel PR. The second select signal is a signal for selecting the G (second color component) pixel PG. The third select signal is a signal for selecting the B (third color component) pixel PB.

The signal lines $SL_1$ to $SL_N$ are driven by the source driver 40. The source driver 40 outputs voltages corresponding to the gray-scale data to the pixels for each color component. The source driver 40 outputs the voltages which are time-divided for each pixel and correspond to the gray-scale data for each color component to the signal line corresponding to each pixel. The source driver 40 generates the demultiplex control signal for selectively outputting the voltages corresponding to the gray-scale data for each color component to each color component signal line in synchronization with the time-division timing, and outputs the demultiplex control signal to the display panel 10.

The first to third color component signal lines ($R_n$, $G_n$, $B_n$) are connected to the output side of the demultiplexer $DMUX_n$. The signal line $SL_n$ is connected to the input side of the demultiplexer $DMUX_n$. The demultiplexer $DMUX_n$ electrically connects the signal line $SL_n$ with one of the first to third color component signal lines ($R_n$, $G_n$, $B_n$) in response to the demultiplex control signal. The demultiplex control signal is input in common to the demultiplexers $DMUX_1$ to $DMUX_N$.

In FIG. 1, at least one of the gate driver 30 and the source driver 40 may be formed on the panel substrate of the display panel 10.

The function of the driver circuit of the display panel (electro-optical device in a broad sense) 10 in the present embodiment is realized by a part or all of the circuits formed by the select signal generation circuit 20, the demultiplexers $DMUX_1$ to $DMUX_N$, the gate driver 30, and the source driver 40.

The following description is given taking one pixel (three dots) specified by the scan line $GL_m$ and the signal line $SL_n$ as an example for convenience of illustration.

Figure 2:
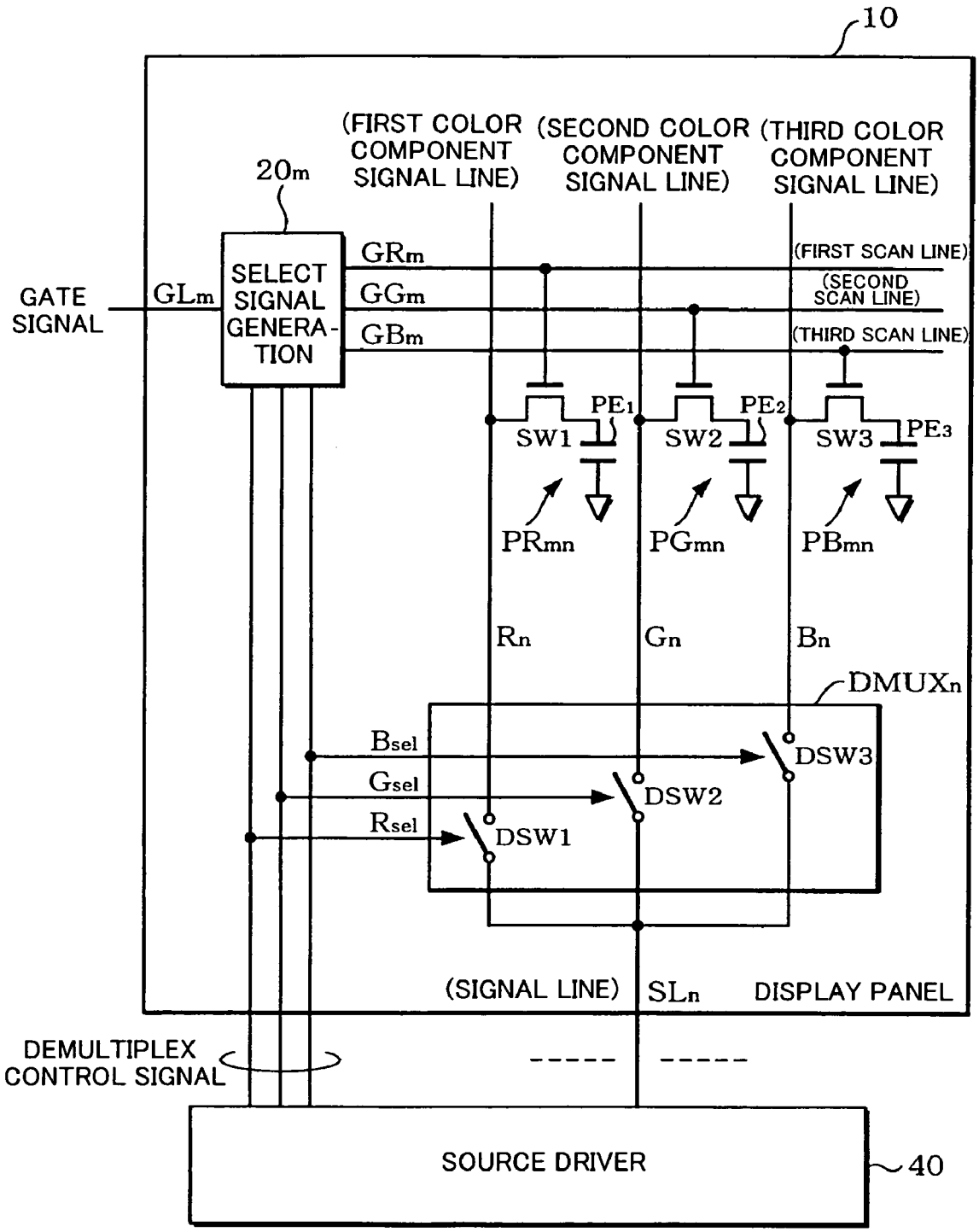
FIG. 2 is a principle configuration diagram of a display panel in an embodiment of the present invention.

FIG. 2 shows a principle configuration of the display panel 10 in the present embodiment. In FIG. 2, sections the same as the sections shown in FIG. 1 are indicated by the same symbols. Description of these sections is appropriately omitted.

The first to third (i=3) scan lines ($GR_m$, $GG_m$, $GB_m$) are formed on the panel substrate which makes up the display panel 10 corresponding to the scan line $GL_m$. The first to third (i=3) color component signal lines ($R_n$, $G_n$, $B_n$) are formed on the panel substrate corresponding to the signal line $SL_n$. The color component pixels $PR_{mn}$, $PG_{mn}$, and $PB_{mn}$ are formed on the panel substrate at intersecting points of the first to third scan lines ($GR_m$, $GG_m$, $GB_m$) and the first to third color component signal lines ($R_n$, $G_n$, $B_n$). The color component pixels $PR_{mn}$, $PG_{mn}$, and $PB_{mn}$ respectively include first to third (i=3) switching elements SW1 to SW3 and first to third (i=3) pixel electrodes $PE_1$ to $PE_3$. Each of the first to third switching elements SW1 to SW1 is formed by using a TFT.

Figure 3A:
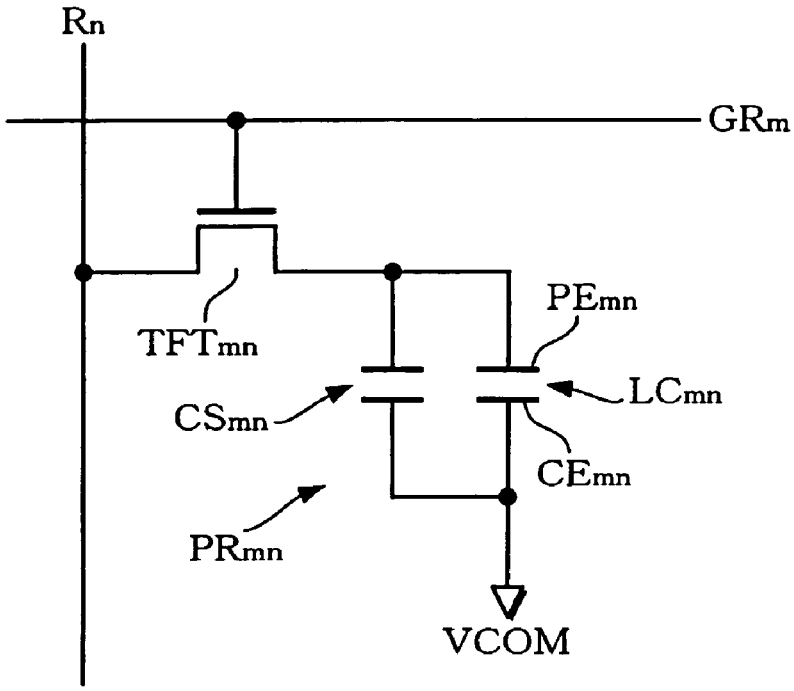
FIGS. 3A and 3B are diagrams showing configuration examples of a color component pixel.
Figure 3B:
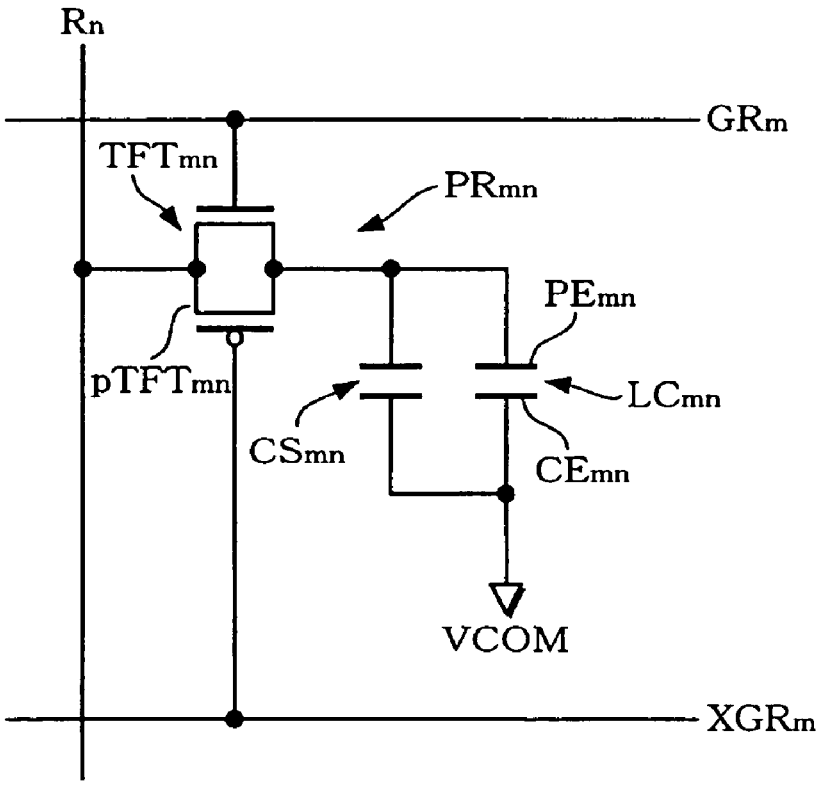

FIGS. 3A and 3B show examples of the color component pixel. FIGS. 3A and 3B show configuration examples of the R pixel $PR_{mn}$. Other color component pixels have the same configuration as that of the R pixel.

In FIG. 3A, the $TFT_{mn}$ as the first switching element SW 1 is an n-type transistor. A gate electrode of the $TFT_{mn}$ is connected to the first scan line $GR_m$. A source electrode of the $TFT_{mn}$ is connected to the first color component signal line $R_n$. A drain electrode of the $TFT_{mn}$ is connected to the pixel electrode $PE_{mn}$. A common electrode $CE_{mn}$ is formed to face the pixel electrode $PE_{mn}$. A common voltage VCOM is applied to the common electrode $CE_{mn}$. A liquid crystal material is interposed between the pixel electrode $PE_{mn}$ and the common electrode $CE_{mn}$, whereby a liquid crystal layer $LC_{mn}$ is formed. The transmittance of the liquid crystal layer $LC_{mn}$ is changed corresponding to the voltage applied between the pixel electrode $PE_{mn}$ and the common electrode $CE_{mn}$. A storage capacitor $CS_{mn}$ is formed in parallel with the pixel electrode $PE_{mn}$ and the common electrode $CE_{mn}$ in order to compensate for charge leakage of the pixel electrode $PE_{mn}$. One end of the storage capacitor $CS_{mn}$ is set at the same potential as the pixel electrode $PE_{mn}$. The other end of the storage capacitor $CS_{mn}$ is set at the same potential as the common electrode $CE_{mn}$.

As shown in FIG. 3B, a transfer gate may be used as the first switching element SW1. The transfer gate is formed of an n-type transistor $TFT_{mn}$ and a p-type transistor $pTFT_{mn}$. A gate electrode of the $pTFT_{mn}$ must be connected to a scan line $XGR_m$ of which the logic level is the inverse of the logic level of the first scan line $GR_m$. In FIG. 3B, a configuration is employed in which an offset voltage corresponding to the voltage to be written is unnecessary.

In FIG. 2, the first to third switching elements SW1 to SW3 are controlled (ON/OFF controlled) by the first to third (i=3) select signals supplied to the first to third scan lines ($GR_m$, $GG_m$, $GB_m$). The color component signal line is electrically connected to the pixel electrode when the switching element is in an ON state.

The demultiplexer $DMUX_n$ corresponding to the signal line $SL_n$ is formed on the panel substrate. The demultiplex control signal generated by the source driver 40 is supplied to the demultiplexer $DMUX_n$. In FIG. 2, the demultiplex control signal includes first to third (i=3) demultiplex control signals (Rsel, Gsel, Bsel).

The demultiplexer $DMUX_n$ includes first to third (i=3) demultiplex switching elements DSW1 to DSW3. The first demultiplex switching element DSW1 is ON/OFF controlled by the first demultiplex control signal Rsel. The second demultiplex switching element DSW2 is ON/OFF controlled by the second demultiplex control signal Gsel. The third demultiplex switching element DSW3 is ON/OFF controlled by the third demultiplex control signal Bsel. Since the first to third demultiplex control signals (Rsel, Gsel, Bsel) periodically and consecutively go active, the demultiplexer $DMUX_n$ periodically and consecutively connects the signal line $SL_n$ electrically with the first to third color component signal lines ($R_n$, $G_n$, $B_n$).

The select signal generation circuit $\mathbf{20}_m$ generates the first to third select signals based on the first to third demultiplex control signals (Rsel, Gsel, Bsel). The first select signal is output to the first scan line $GR_m$. The second select signal is output to the second scan line $GG_m$. The third select signal is output to the third scan line $GB_m$. The select signal generation circuit $\mathbf{20}_m$ may generate the first to third select signals based on the first to third demultiplex control signals (Rsel, Gsel, Bsel) and the gate signal input through the scan line $GL_m$. In this case, since the first to third select signals can be generated corresponding to the select period of one pixel formed of the first to third color components, signals between which the change is minimum are generated, whereby power consumption can be reduced.

In the display panel 10 having such a configuration, the time-divided voltages corresponding to the gray-scale data for the first to third color components are output to the signal line $SL_n$. In the demultiplexer $DMUX_n$, the voltages corresponding to the gray-scale data for each color component are applied to the first to third color component signal lines ($R_n$, $G_n$, $B_n$) by the first to third demultiplex control signals (Rsel, Gsel, Bsel) generated in synchronization with the time-division timing. The color component signal line is electrically connected to the pixel electrode in one of the first to third color component pixels ($PR_{mn}$, $PG_{mn}$, $PB_{mn}$) selected by the first to third scan lines ($GR_m$, $GG_m$, $GB_m$).

The select signal generation circuit $\mathbf{20}_m$ in the present embodiment generates the jth select signal ($1 \leqq j \leqq i$ (i=3 in this example), j is an integer) as described below.

Figure 4:
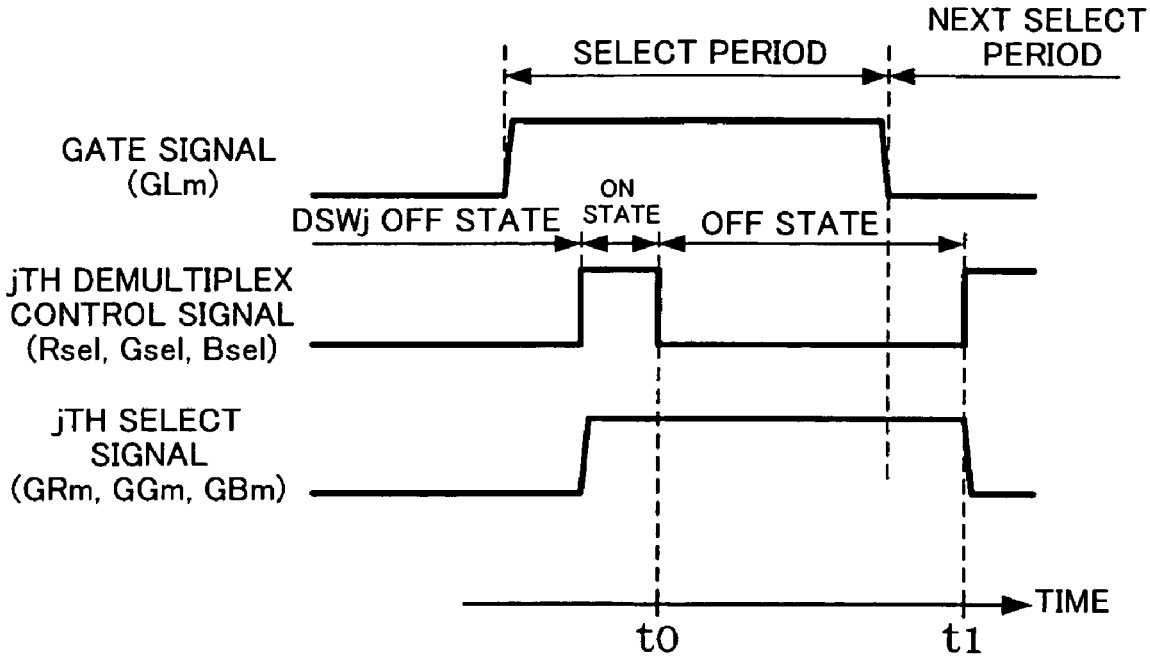
FIG. 4 is an operation explanatory diagram of a select signal generation circuit.

FIG. 4 is a view illustrating the jth select signal which is generated by the select signal generation circuit $\mathbf{20}_m$. The select signal generation circuit $\mathbf{20}_m$ generates the jth select signal which controls switching of the jth switching element SWj. The select signal generation circuit $\mathbf{20}_m$ generates the jth select signal so that at least the jth switching element SWj is in an ON state when the jth demultiplex switching element DSWj shifts from an ON state to an OFF state in the select period of the pixel specified by the gate signal input through the scan line $GL_m$. The select signal generation circuit $\mathbf{20}_m$ generates the jth select signal so that at least the jth switching element SWj is set to an OFF state before the jth demultiplex switching element DSWj is set to an ON state in the select period of the pixel specified by the gate signal input through the scan line $G_{m+1}$ (select period of the next pixel).

Specifically, the jth select signal sets at least the jth switching element SWj to an ON state at a time t0 at which the jth demultiplex switching element DSWj shifts from an ON state to an OFF state. The jth select signal sets at least the jth switching element SWj to an OFF state at a time t1 at which the jth demultiplex switching element DSWj which has shifted to the OFF state at the time t0 shifts from the OFF state to the ON state in the select period of the next pixel.

The write time of the color component pixel can be sufficiently secured by generating the jth select signal by using the select signal generation circuit $\mathbf{20}_m$ as described above. Moreover, the write time of each color component pixel can be made uniform irrespective of the order of writing of the gray-scale data (display data) for each color component in the select period of the pixel, whereby the image quality can be improved.

A configuration example of the display panel 10 is described below.

The source driver 40 which supplies the time-divided voltages corresponding to the gray-scale data for each color component to the signal line $SL_n$ of the display panel 10 is described below.

Figure 5:
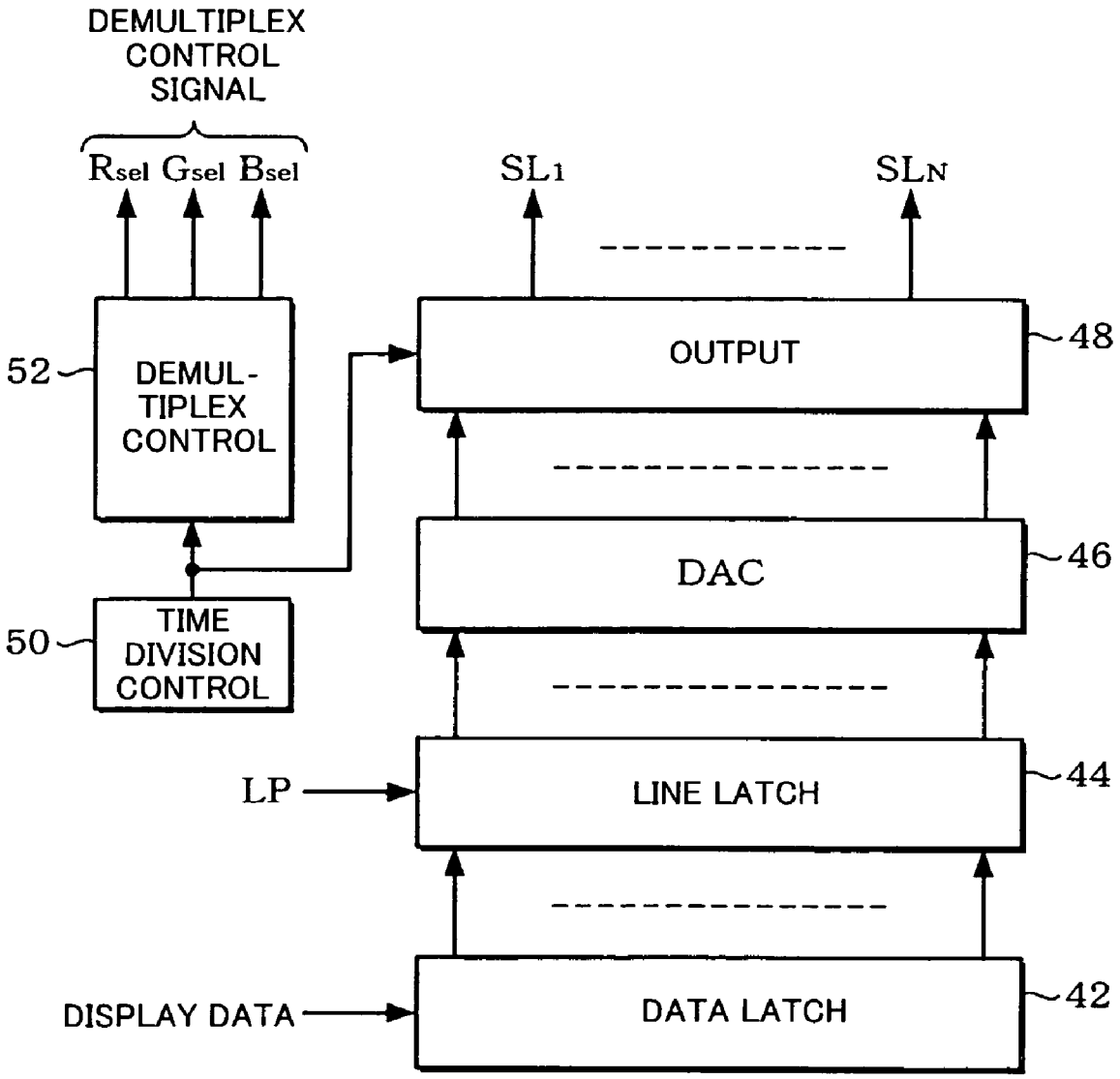
FIG. 5 is a block diagram showing a configuration example of a source driver.

FIG. 5 shows a block configuration example of the source driver 40. The source driver 40 includes a data latch 42, a line latch 44, a digital-to-analog converter (DAC) 46, an output circuit 48, a time division control circuit 50, and a demultiplex control circuit 52.

The data latch 42 latches the gray-scale data input in series. The line latch 44 captures latch data $D_1$ to $D_{3N}$ latched by the data latch 42 in synchronization with a latch pulse signal LP. The DAC 46 generates drive voltages corresponding to the gray-scale data for each color component of each pixel for the latch data for one line captured by the line latch 44. The output circuit 48 time-divides the drive voltages corresponding to each color component in units of pixels, and outputs the time-divided drive voltages to the corresponding signal line.

The time division control circuit 50 generates time-division timing of the output timing of each color component in units of pixels. The output circuit 48 outputs the drive voltages time-divided according to the timing instructed by the time division control circuit 50. The demultiplex control circuit 52 generates the first to third demultiplex control signals (Rsel, Gsel, Bsel) according to the timing instructed by the time division control circuit 50.

The first to third demultiplex control signals (Rsel, Gsel, Bsel) thus generated are input to the select signal generation circuit $\mathbf{20}_m$ of the display panel 10.

A part or all of the blocks of the source driver 40 shown in FIG. 5 may be directly formed on the panel substrate which makes up the display panel 10.

Figure 6:
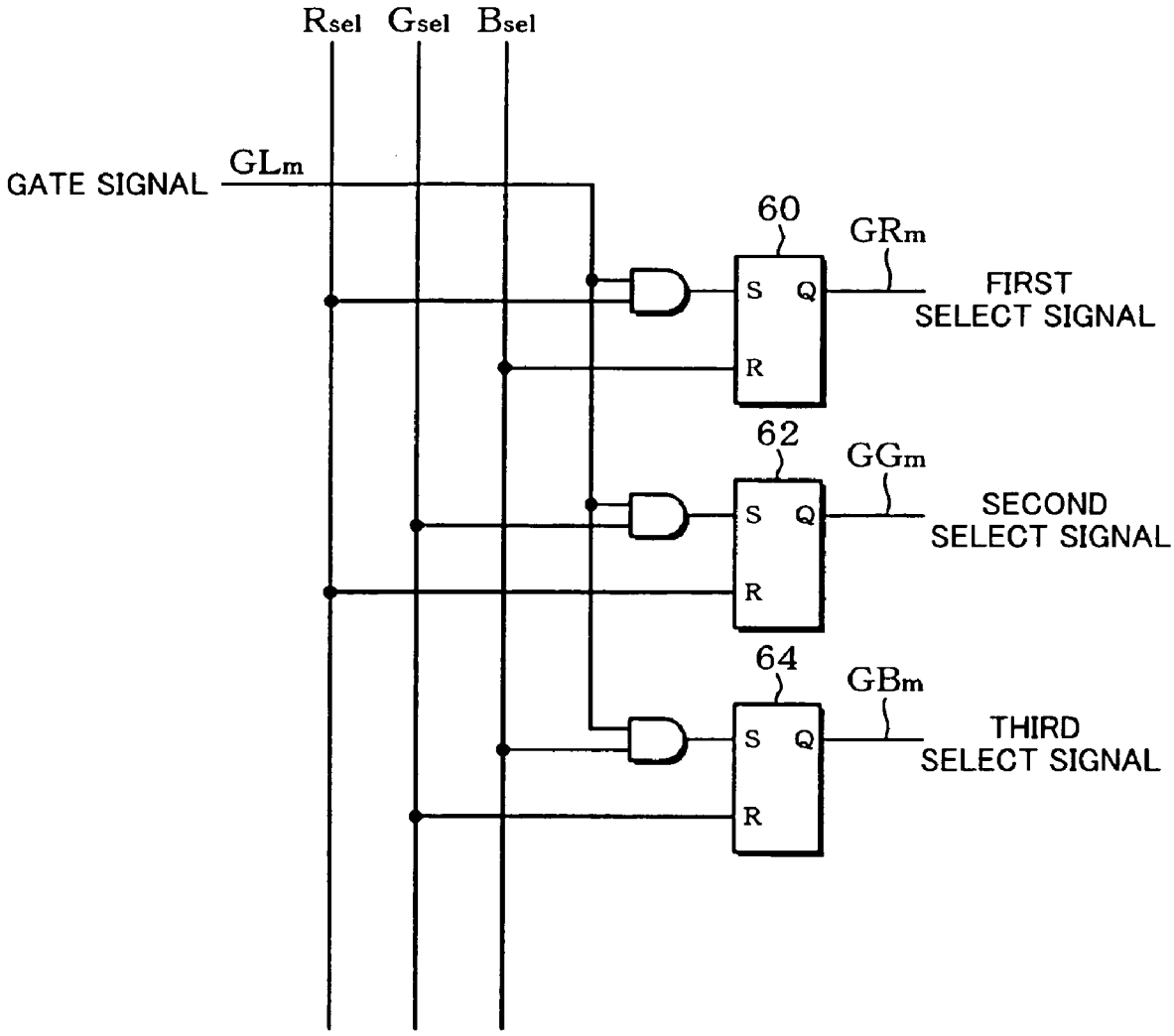
FIG. 6 is a circuit diagram showing a configuration example of a select signal generation circuit.

FIG. 6 shows a configuration example of the select signal generation circuit $\mathbf{20}_m$. The select signal generation circuit $\mathbf{20}_m$ includes reset set flip-flops (RS-FFs) (first to third flip-flops) 60, 62, and 64. The RS-FF includes a set terminal S, a reset terminal R, and an output terminal Q. The RS-FF sets a signal output from the output terminal Q (logic level "H", for example) when the logic level of a set signal input to the set terminal S becomes "H", for example. The RS-FF resets the signal output from the output terminal Q (logic level "L", for example) when the logic level of a set signal input to the reset terminal R becomes "H", for example. The select signals for controlling switching of the switching elements for each color component are output from the output terminal of each RS-FF.

The AND operation result of the scan line $GL_m$ and the first demultiplex control signal Rsel is input to the set terminal S of the RS-FF (first flip-flop) 60. The third demultiplex control signal Bsel is input to the reset terminal R of the RS-FF 60. The first scan line $GR_m$ is connected to the output terminal Q of the RS-FF 60.

The AND operation result of the scan line $GL_m$ and the second demultiplex control signal Gsel is input to the set terminal S of the RS-FF (second flip-flop) 62. The first demultiplex control signal Rsel is input to the reset terminal R of the RS-FF 62. The second scan line $GG_m$ is connected to the output terminal Q of the RS-FF 62.

The AND operation result of the scan line $GL_m$ and the third demultiplex control signal Bsel is input to the set terminal S of the RS-FF (third flip-flop) 64. The second demultiplex control signal Gsel is input to the reset terminal R of the RS-FF 64. The third scan line $GB_m$ is connected to the output terminal Q of the RS-FF 64.

The select signal generation circuit $\mathbf{20}_q$ ($1 \leqq q \leqq M$, q is an integer excluding m) corresponding to another scan line may have the same configuration as described above.

Figure 7:
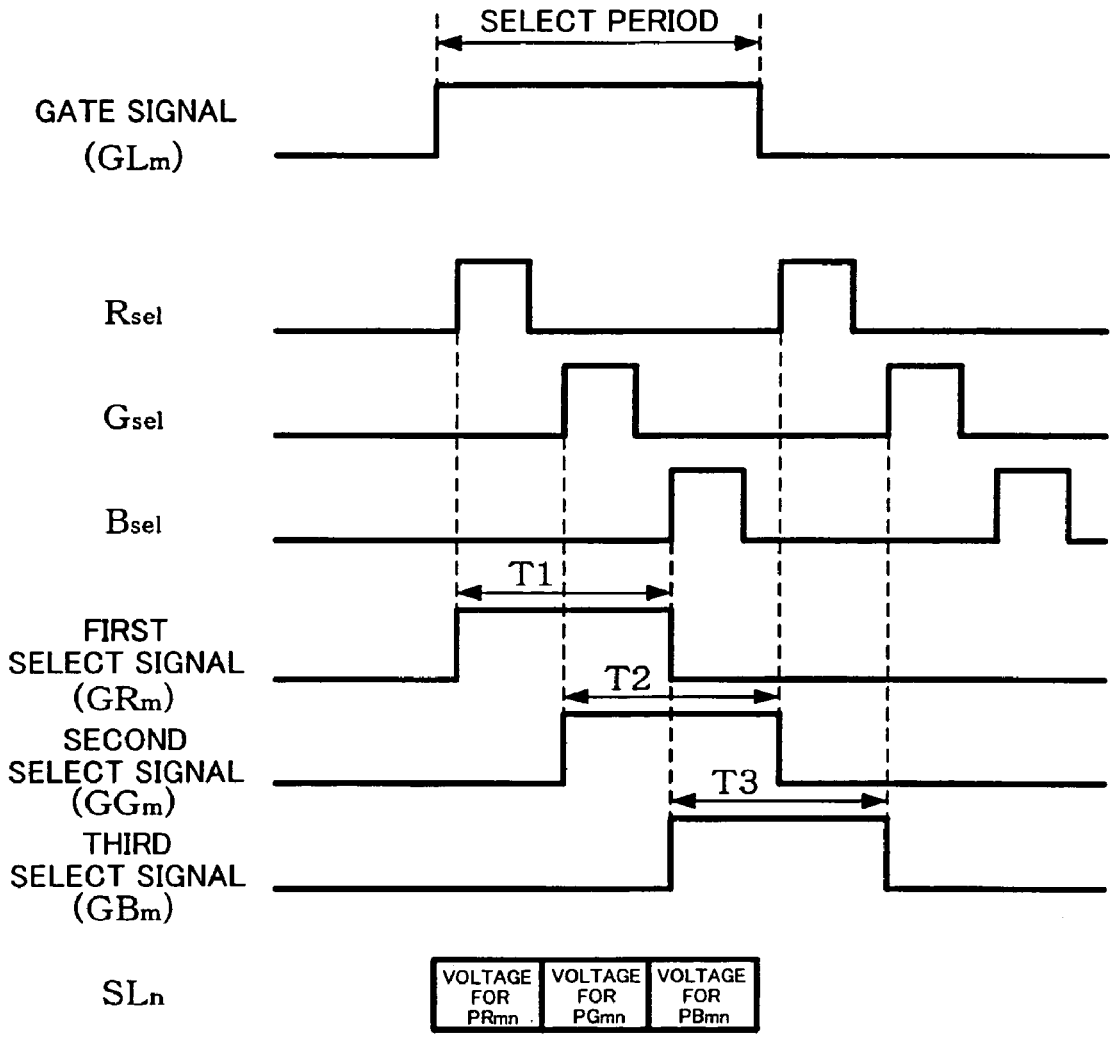
FIG. 7 is a timing chart of an example of timing in an embodiment of the present invention.

FIG. 7 shows an example of a timing chart in the present embodiment. The gate driver 30 consecutively selects the scan lines $GL_1$ to $GL_M$ and outputs the gate signal to the selected scan line. The source driver 40 outputs the first to third demultiplex control signals (Rsel, Gsel, Bsel) to the display panel 10 so that the time-divided voltages for each color component output to the signal line are selectively output to each color component signal line in the select period of each scan line.

The select signal generation circuit $\mathbf{20}_m$ generates the first to third select signals by the configuration shown in FIG. 6, and outputs the first to third select signals to the first to third scan lines ($GR_m$, $GG_m$, $GB_m$). The first select signal is set at a rising edge of the first demultiplex control signal Rsel, and reset at a rising edge of the third demultiplex control signal Bsel. The second select signal is set at a rising edge of the second demultiplex control signal Gsel, and reset at a rising edge of the first demultiplex control signal Rsel. The third select signal is set at a rising edge of the third demultiplex control signal Bsel, and reset at a rising edge of the second demultiplex control signal Gsel.

The color component signal line can be electrically connected to the pixel electrode through the switching element of each dot even after each demultiplex switching element is in an OFF state by generating each select signal in this manner. Therefore, the write time of each color component can be made uniform (T1=T2=T3). Moreover, the select signal generation circuit $\mathbf{20}_m$ can be realized with a simple circuit configuration such as the flip-flops and the AND circuits.

The signals connected to the set terminal and the reset terminal of the RS-FF which makes up the select signal generation circuit $\mathbf{20}_m$ are not limited to those shown in FIG. 6. The jth flip-flop ($1 \leqq j \leqq i=3$, j is an integer) of the select signal generation circuit $\mathbf{20}_m$ may generate the jth select signal by utilizing the configuration in which the first to third (i=3) demultiplex control signals (Rsel, Gsel, Bsel) periodically go active in that order. In more detail, in the case where the RS-FF is set by the jth demultiplex control signal ($1 \leqq j \leqq i$ (=3), j is an integer), the RS-FF may be reset by one of the first to ith demultiplex control signal other than the jth demultiplex control signal. This enables the write time to be secured sufficiently even in the case where the write time of each color component cannot be made uniform. This prevents deterioration of the image quality which occurs in the case where the write time of one color component which makes up the pixel is insufficient.

The select signal output from the RS-FF which makes up the select signal generation circuit $\mathbf{20}_m$ is reset at a rising edge of the demultiplex control signal. However, the present invention is not limited thereto. The select signal may be reset at a falling edge of the demultiplex control signal.

The effect of the present embodiment is described below by comparing the display panel 10 with a display panel in a comparative example.

Figure 8:
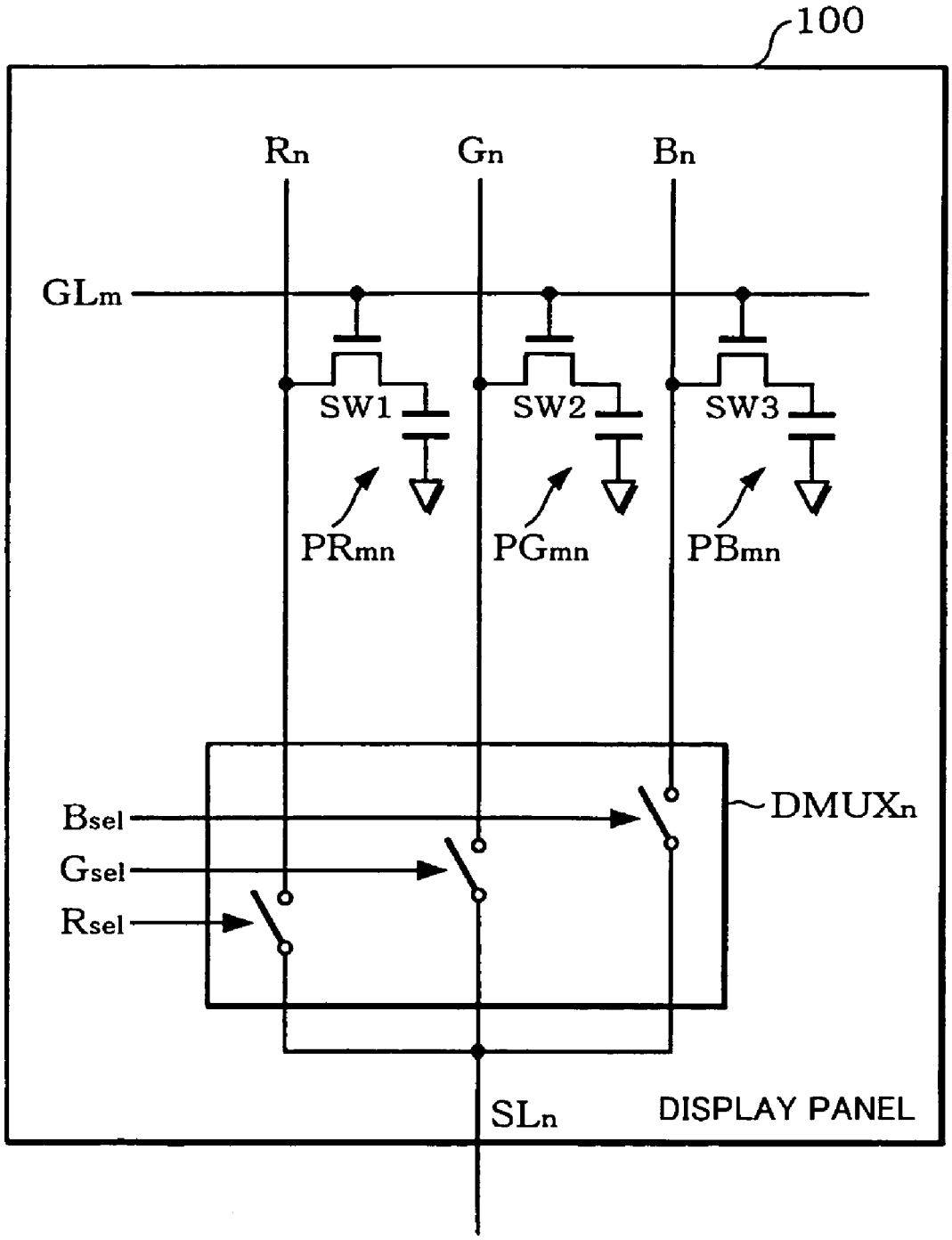
FIG. 8 is a block diagram showing an outline of a configuration of a display panel in a comparative example.

FIG. 8 shows an outline of a configuration of a display panel in the comparative example. In FIG. 8, sections the same as the sections of the display panel 10 in the present embodiment shown in FIG. 2 are indicated by the same symbols. Description of these sections is appropriately omitted. A display panel 100 in the comparative example differs from the display panel 10 in the present embodiment in that the display panel 100 does not include the select signal generation circuit $\mathbf{20}_m$. Therefore, in the display panel 100 in the comparative example, the scan line $GL_m$ to which the gate signal is output by the gate driver 30 is connected in common with the switching elements of each color component pixel ($PR_{mn}$, $PG_{mn}$, $PB_{mn}$) which makes up one pixel.

Figure 9:
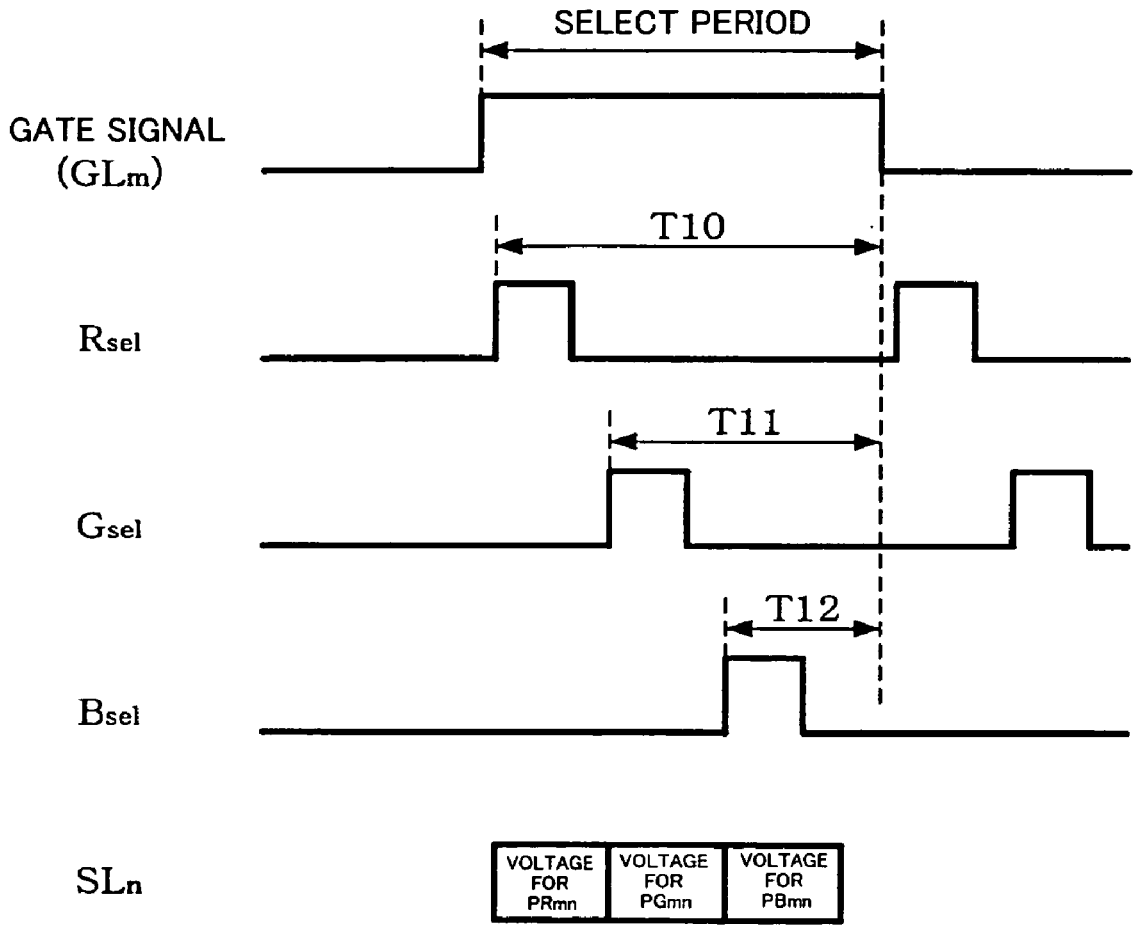
FIG. 9 is a timing chart of an example of timing in a comparative example.

FIG. 9 shows an example of a timing chart of the display panel in the comparative example. The gate signal is output to the scan line $GL_m$ of the display panel 100 in the comparative example by the gate driver in the select period of the scan line $GL_m$. Therefore, the first to third switching elements SW1 to SW3 connected to the scan line $GL_m$ are turned ON at the same time, whereby each color component signal line is electrically connected to each pixel electrode.

The source driver controls so that the time-divided voltages for each color component output to the signal line are selectively output to each color component signal line in the select period of each scan line, as described above. Therefore, the timing chart of the display panel 100 is the same as the timing chart of the display panel 10 in the present embodiment shown in FIG. 7 in that the demultiplexer $DMUX_n$ is controlled by the first to third demultiplex control signals (Rsel, Gsel, Bsel) as shown in FIG. 9.

Therefore, the write time of each color component pixel differs depending on the order of writing in the select period of the pixel (T10>T11>T12). Specifically, the write time is secured for the R pixel $PR_{mn}$ and the G pixel $PG_{mn}$. Therefore, the potential of the pixel electrode is changed due to the change in the structure of the liquid crystal layer. However, the write time is not sufficiently secured for the B pixel $PB_{mn}$. Therefore, the structure of the liquid crystal layer cannot be changed sufficiently. This causes the B pixel $PB_{mn}$ to be displayed by the characteristics of the liquid crystal differing from those of the R pixel $PR_{mn}$ and the G pixel $PG_{mn}$, whereby the image quality deteriorates. This phenomenon becomes more significant as the select period of the pixel is reduced due to an increase in the screen size. The above problem may be solved by using a method in which the write control for the B pixel $PB_{mn}$ differs from the write control for the R pixel $PR_{mn}$ and the G pixel $PG_{mn}$. However, this method causes the circuits to be complicated since an additional circuit is necessary.

According to the present embodiment, the write time of each color component can be sufficiently secured or the write time can be made uniform with a simple configuration without depending on the write time of each color component in the select period of the pixel, as shown in FIG. 7. Therefore, writing for each color component can be stabilized, whereby the image quality can be improved.

The select signal generation circuit 20 shown in FIG. 1 (select signal generation circuit $\mathbf{20}_m$ shown in FIG. 2) is not necessarily formed on the panel substrate of the display panel.

Figure 10:
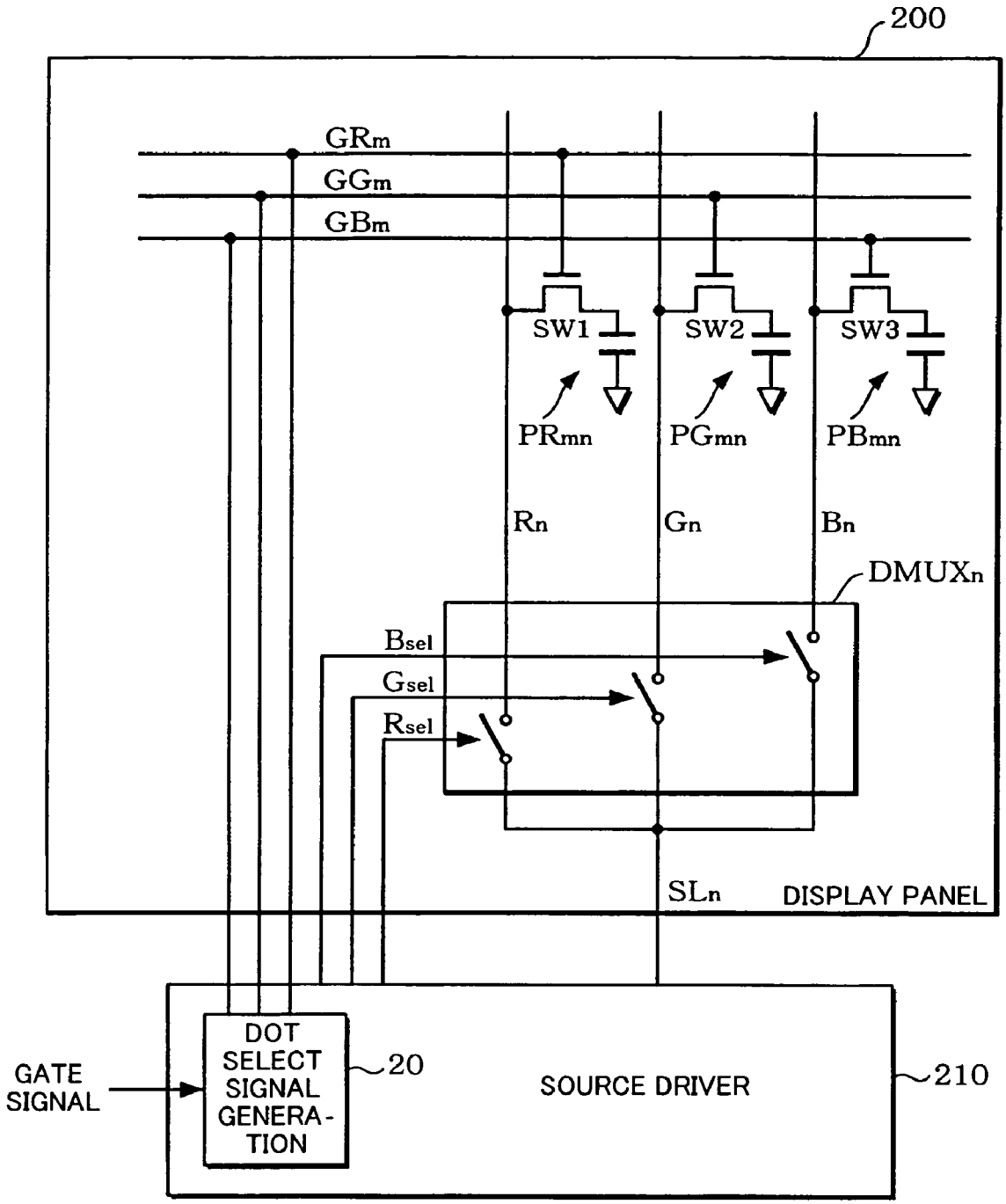
FIG. 10 is a block diagram showing an outline of a configuration of a display panel in a modification example.

FIG. 10 shows an outline of a configuration of a display panel in a modification example. In a display panel 200 in this modification example, the select signal generation circuit 20 shown in FIG. 1 is included in a source driver 210.

The source driver 210 has the same function as that of the source driver 40 having the configuration shown in FIG. 5 except that the source driver 210 includes the select signal generation circuit 20. In this case, the gate signals supplied to the scan lines $GL_1$ to $GL_M$ from the gate driver (not shown) are input to the select signal generation circuit 20 of the source driver 210.

According to this modification example, the configuration of the display panel 200 formed by the LTPS process in which the manufacturing conditions are more severe than the process for the source driver 210 can be simplified.

The present invention is not limited to the above-described embodiment. Various modifications and variations are possible within the spirit and scope of the present invention.

The order in which the first to ith demultiplex control signals periodically go active is not limited to the order in the above-described embodiment.

The invention according to the dependent claims may have a configuration in which a part of the constituent elements of the claim on which the invention is dependent is omitted. It is possible to allow the feature of the invention according to one independent claim to depend on another independent claim.

The specification discloses the following matters about the configuration of the embodiments described above.

According to one embodiment of the present invention, there is provided a driver circuit for driving an electro-optical device which has:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element; and first to ith demultiplex switching elements, each of which is connected to the jth color component signal line at one end and to a signal line at the other end, and is controlled by a jth demultiplex control signal, multiplexed first to ith color component signals being output to the signal line, the driver circuit comprising a select signal generation circuit which generates first to ith select signals, the first to ith select signals controlling the first to ith switching elements based on first to ith demultiplex control signals respectively, wherein the select signal generation circuit generates the jth select signal so that at least the jth switching element is in an ON state when a jth demultiplex switching element shifts from an ON state to an OFF state and that the jth switching element is set to an OFF state before the jth demultiplex switching element is set to the ON state again after the jth demultiplex switching element has shifted to the OFF state.

One pixel is formed of i dots in which each of the first to ith color component signals is written, for example.

In this driver circuit, each of the multiplexed first to ith color component signals is selectively output to each of the first to ith color component signal lines by the first to ith demultiplex switching elements. The first to ith color component signals on the first to ith color component signal lines are written in the first to ith pixel electrodes. The electrical connection between the first to ith pixel electrodes and the first to ith color component signal lines is controlled by the first to ith switching elements.

The first to ith switching elements are controlled by the first to ith select signals output to the first to ith scan lines. At least the jth switching element is set to an ON state when the jth demultiplex switching element shifts from an ON state to an OFF state. This allows the jth color component signal among the multiplexed first to ith color component signals to be output to the corresponding jth color component signal line. Since the jth switching element is set to an ON state, writing to the jth pixel electrode begins.

In this driver circuit, the jth switching element is set to an OFF state based on the jth select signal before the jth demultiplex switching element is set to an ON state again, even after the jth demultiplex switching element has shifted to the ON state. This enables the write time of each color component to be sufficiently secured irrespective of the order of writing of each color component in the select period of the pixel formed of each color component for i dots. Moreover, since the write time of each color component pixel can be made uniform, the image quality can be improved.

In this driver circuit, the select signal generation circuit may include first to ith flip-flops, each of which outputs the jth select signal, and in a case where the first to ith demultiplex control signals cyclically go active in order from the first to ith demultiplex control signals, a jth flip-flop may output the jth select signal which is set by the jth demultiplex control signal and reset by one of the first to ith demultiplex control signals other than the jth demultiplex control signal.

According to this driver circuit, the jth select signal can be generated with an extremely simple configuration. Therefore, the driver circuit can be easily formed on the panel substrate on which transistors are formed by LTPS.

In this driver circuit, the first flip-flop may output the first select signal which is set by the first demultiplex control signal and reset by the ith demultiplex control signal, and a kth flip-flop ($2 \leqq k \leqq i$, k is an integer) may output a kth select signal which is set by a kth demultiplex control signal and reset by a (k−1)th demultiplex control signal.

According to this driver circuit, the write time of each color component can be made uniform. Moreover, the select signal generation circuit can be realized with a simple circuit configuration such as flip-flops and AND circuits.

In this driver circuit, the jth flip-flop may output the jth select signal which is set only in a select period of a pixel formed of first to ith color components corresponding to the first to ith color component signal lines.

According to this driver circuit, the first to ith select signals which change only in a select period of a pixel can be generated, whereby power consumption can be reduced.

According to another embodiment of the present invention, there is provided an electro-optical device comprising:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element; and first to ith demultiplex switching elements, each of which is connected to the jth color component signal line at one end and to a signal line at the other end, and is controlled by a jth demultiplex control signal, multiplexed first to ith color component signals being output to the signal line, wherein the jth switching element is set to an ON state based on the jth select signal when a jth demultiplex switching element shifts from an ON state to an OFF state, and set to an OFF state based on the jth select signal before the jth demultiplex switching element is set to the ON state again after the jth demultiplex switching element has shifted to the OFF state.

According to a further embodiment of the present invention, there is provided an electro-optical device comprising:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element;

first to ith demultiplex switching elements, each of which is connected to the jth color component signal line at one end and to a signal line at the other end, and is controlled by a jth demultiplex control signal, multiplexed first to ith color component signals being output to the signal line; and a select signal generation circuit which generates first to ith select signals, the first to ith select signals controlling the first to ith switching elements based on first to ith demultiplex control signals respectively, wherein the select signal generation circuit generates the jth select signal so that at least the jth switching element is in an ON state when a jth demultiplex switching element shifts from an ON state to an OFF state and that the jth switching element is set to an OFF state before the jth demultiplex switching element is set to the ON state again after the jth demultiplex switching element has shifted to the OFF state.

In this electro-optical device, the select signal generation circuit may include first to ith flip-flops, each of which outputs the jth select signal, and in a case where the first to ith demultiplex control signals cyclically go active in order from the first to ith demultiplex control signals, a jth flip-flop may output the jth select signal which is set by the jth demultiplex control signal and reset by one of the first to ith demultiplex control signals other than the jth demultiplex control signal.

In this electro-optical device, the first flip-flop may output the first select signal which is set by the first demultiplex control signal and reset by the ith demultiplex control signal, and a kth flip-flop ($2 \leqq k \leqq i$, k is an integer) may output a kth select signal which is set by a kth demultiplex control signal and reset by a (k−1)th demultiplex control signal.

In this electro-optical device, the jth flip-flop may output the jth select signal which is set only in a select period of a pixel formed of first to ith color components corresponding to the first to ith color component signal lines.

According to a still another embodiment of the present invention, there is provided a method of driving an electro-optical device which has:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element; and first to ith demultiplex switching elements, each of which is connected to the jth color component signal line at one end and to a signal line at the other end, and is controlled by a jth demultiplex control signal, multiplexed first to ith color component signals being output to the signal line, the method comprising setting at least the jth switching element to an ON state based on the jth select signal when a jth demultiplex switching element shifts from an ON state to an OFF state, and setting the jth switching element to an OFF state based on the jth select signal before the jth demultiplex switching element is set to the ON state again after the jth demultiplex switching element has shifted to the OFF state.

In this driving method, in a case where first to ith demultiplex control signals cyclically go active in order from the first to ith demultiplex control signals, the jth select signal may be set by the jth demultiplex control signal and reset by one of the first to ith demultiplex control signals other than the jth demultiplex control signal.

In this driving method, a first select signal may be set by the first demultiplex control signal and reset by the ith demultiplex control signal, and a kth select signal ($2 \leqq k \leqq i$, k is an integer) may be set by a kth demultiplex control signal and reset by a (k−1)th demultiplex control signal.

In this driving method, the jth select signal may be set only in a select period of a pixel formed of first to ith color components corresponding to the first to ith color component signal lines.

What is claimed is:

1. A driver circuit for driving an electro-optical device which has:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element; and first to ith demultiplex switching elements, each of which is connected to the jth color component signal line at one end and to a signal line at the other end, and is controlled by a jth demultiplex control signal, multiplexed first to ith color component signals being output to the signal line, the driver circuit comprising a select signal generation circuit which generates first to ith select signals, the first to ith select signals controlling the first to ith switching elements based on first to ith demultiplex control signals respectively, wherein the select signal generation circuit generates the jth select signal so that at least the jth switching element is in an ON state when a jth demultiplex switching element shifts from an ON state to an OFF state and that the jth switching element is set to an OFF state before the jth demultiplex switching element is set to the ON state again after the jth demultiplex switching element has shifted to the OFF state, wherein the select signal generation circuit includes first to ith flip-flops, each of which outputs the jth select signal, and wherein, in a case where the first to ith demultiplex control signals cyclically go active in order from the first to ith demultiplex control signals, a jth flip-flop outputs the jth select signal which is set by the jth demultiplex control signal and reset by one of the first to ith demultiplex control signals other than the jth demultiplex control signal.

2. The driver circuit as defined in claim 1, wherein the first flip-flop outputs the first select signal which is set by the first demultiplex control signal and reset by the ith demultiplex control signal, and wherein a kth flip-flop ($2 \leqq k \leqq i$, k is an integer) outputs a kth select signal which is set by a kth demultiplex control signal and reset by a (k−1)th demultiplex control signal.

3. The driver circuit as defined in claim 1, wherein the jth flip-flop outputs the jth select signal which is set only in a select period of a pixel formed of first to ith color components corresponding to the first to ith color component signal lines.

4. An electro-optical device comprising:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element; and first to ith demultiplex switching elements, each of which is connected to the jth color component signal line at one end and to a signal line at the other end, and is controlled by a jth demultiplex control signal, multiplexed first to ith color component signals being output to the signal line, wherein the jth switching element is set to an ON state based on the jth select signal when a jth demultiplex switching element shifts from an ON state to an OFF state, and set to an OFF state based on the jth select signal before the jth demultiplex switching element is set to the ON state again after the jth demultiplex switching element has shifted to the OFF state, and wherein the first to the ith select signals are generated based on a gate signal and first to ith demultiplex control signals, wherein the select signal generation circuit includes first to ith flip-flops, each of which outputs the jth select signal, and wherein, in a case where the first to ith demultiplex control signals cyclically go active in order from the first to ith demultiplex control signals, a jth flip-flop outputs the jth select signal which is set by the jth demultiplex control signal and reset by one of the first to ith demultiplex control signals other than the jth demultiplex control signal.

5. An electro-optical device comprising:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element;

first to ith demultiplex switching elements, each of which is connected to the jth color component signal line at one end and to a signal line at the other end, and is controlled by a jth demultiplex control signal, multiplexed first to ith color component signals being output to the signal line; and a select signal generation circuit which generates first to ith select signals, the first to ith select signals controlling the first to ith switching elements based on first to ith demultiplex control signals respectively, wherein the select signal generation circuit generates the jth select signal so that at least the jth switching element is in an ON state when a jth demultiplex switching element shifts from an ON state to an OFF state and that the jth switching element is set to an OFF state before the jth demultiplex switching element is set to the ON state again after the jth demultiplex switching element has shifted to the OFF state, wherein the select signal generation circuit includes first to ith flip-flops, each of which outputs the jth select signal, and wherein, in a case where the first to ith demultiplex control signals cyclically go active in order from the first to ith demultiplex control signals, a jth flip-flop outputs the jth select signal which is set by the jth demultiplex control signal and reset by one of the first to ith demultiplex control signals other than the jth demultiplex control signal.

6. The electro-optical device as defined in claim 5 wherein the first flip-flop outputs the first select signal which is set by the first demultiplex control signal and reset by the ith demultiplex control signal, and wherein a kth flip-flop ($2 \leqq k \leqq i$, k is an integer) outputs a kth select signal which is set by a kth demultiplex control signal and reset by a (k−1)th demultiplex control signal.

7. The electro-optical device as defined in claim 5, wherein the jth flip-flop outputs the jth select signal which is set only in a select period of a pixel formed of first to ith color components corresponding to the first to ith color component signal lines.

8. A method of driving an electro-optical device which has:

first to ith scan lines (i is an integer of two or more);

first to ith color component signal lines;

first to ith switching elements, each of which is connected to a jth scan line ($1 \leqq j \leqq i$, j is an integer) and a jth color component signal line and is controlled by a jth select signal supplied to the jth scan line;

first to ith pixel electrodes, each of which is connected to a jth switching element; and first to ith demultiplex switching elements, each of which is connected to the jth color component signal line at one end and to a signal line at the other end, and is controlled by a jth demultiplex control signal, multiplexed first to ith color component signals being output to the signal line, the method comprising setting at least the jth switching element to an ON state based on the jth select signal when a jth demultiplex switching element shifts from an ON state to an OFF state, and setting the jth switching element to an OFF state based on the jth select signal before the jth demultiplex switching element is set to the ON state again after the jth demultiplex switching element has shifted to the OFF state, wherein, in a case where first to ith demultiplex control signals cyclically go active in order from the first to ith demultiplex control signals, the jth select signal is set by the jth demultiplex control signal and reset by one of the first to ith demultiplex control signals other than the jth demultiplex control signal.

9. The method as defined in claim 8, wherein a first select signal is set by the first demultiplex control signal and reset by the ith demultiplex control signal, and a kth select signal ($2 \leqq k \leqq i$, k is an integer) is set by a kth demultiplex control signal and reset by a (k−1)th demultiplex control signal.

10. The driving method as defined in claim 8, wherein the jth select signal is set only in a select period of a pixel formed of first to ith color components corresponding to the first to ith color component signal lines.

* * * * *